US005265597A

United States Patent [19]

Wallis

[11] Patent Number: 5,265,597

[45] Date of Patent: Nov. 30, 1993

[54] PASSENGER OXYGEN MASK HAVING A PLURALITY OF FINGERS AND RECESSES FOR MOUNTING THE MASK TO AN OXYGEN BAG

[75] Inventor: David E. Wallis, El Segundo, Calif.

[73] Assignee: Puritan-Bennett Corporation, Overland Park, Kans.

[21] Appl. No.: 907,407

[22] Filed: Jul. 1, 1992

[51] Int. Cl.[5] ..... A62B 18/02; A62B 9/02

[52] U.S. Cl. ..... 128/205.25; 128/205.17; 128/205.24

[58] Field of Search ..... 128/205.13-205.17, 128/205.24, 205.25; 138/37, 39, 103, 108

[56] References Cited

U.S. PATENT DOCUMENTS

| | | | |
|---|---|---|---|
| 3,720,235 | 3/1973 | Schrock | 138/137 |
| 3,757,776 | 9/1973 | Bauman | 128/205.13 |
| 4,098,271 | 7/1978 | Maddock | 128/205.13 |
| 4,446,864 | 5/1984 | Watson et al. | 128/207.14 |
| 4,559,939 | 12/1985 | Levine et al. | 128/205.25 |
| 4,793,342 | 12/1988 | Haber et al. | 128/205.25 |
| 4,909,247 | 3/1990 | Terrisse et al. | 128/205.25 |
| 5,007,421 | 4/1991 | Stewart | 128/205.25 |

*Primary Examiner*—J. Reed Fisher
*Assistant Examiner*—Kimberly L. Asher
*Attorney, Agent, or Firm*—Hovey, Williams, Timmons & Collins

[57] ABSTRACT

A lightweight, easily maintainable passenger oxygen mask is provided with a face mask sized to cover the mouth and nose of a passenger and a reservoir bag in communication with the face mask. Oxygen is permitted to flow through the bag into the mask, while being prevented from flowing back into the bag. A bag connector is positionable within the bag for holding the bag against the face mask, and cooperative structure is provided on the connector and the mask for providing snap-fit connection between the connector and the face mask to permit the bag connector to be selectively, manually attached to and removed from the face mask.

7 Claims, 3 Drawing Sheets

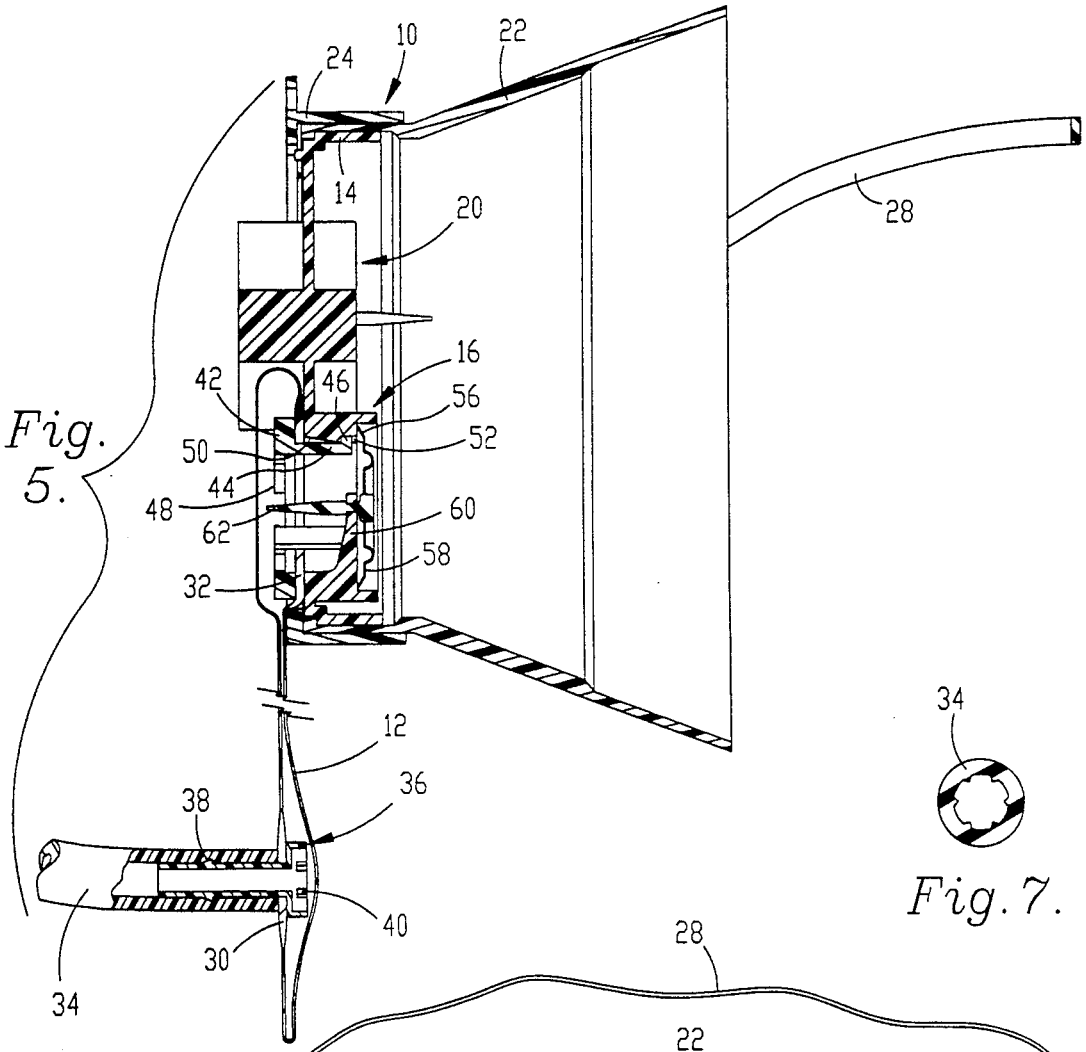
Fig. 5.
Fig. 7.
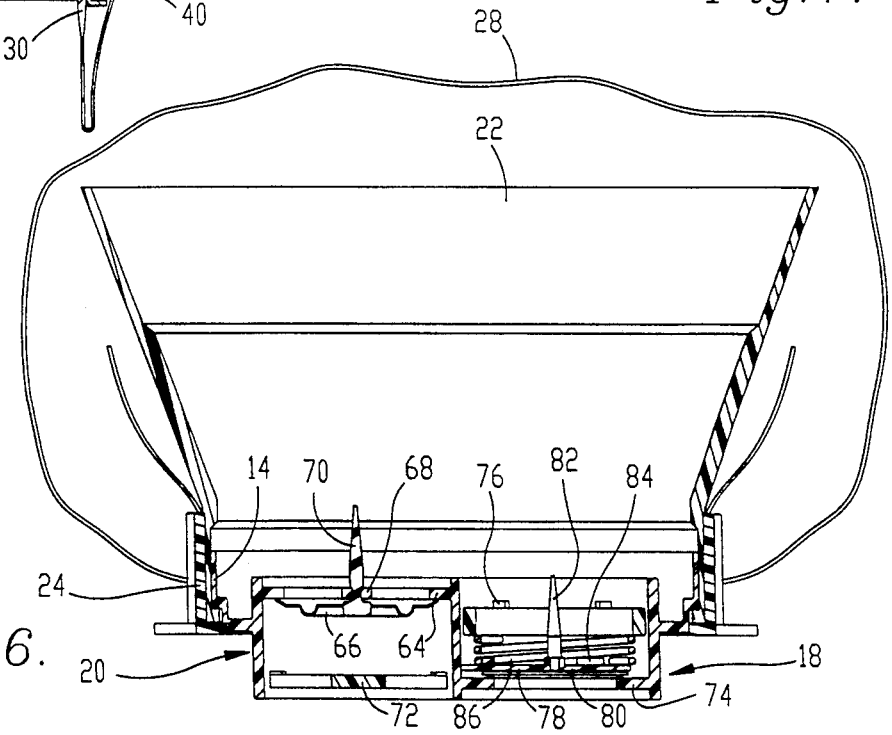
Fig. 6.

PASSENGER OXYGEN MASK HAVING A PLURALITY OF FINGERS AND RECESSES FOR MOUNTING THE MASK TO AN OXYGEN BAG

BACKGROUND OF THE INVENTION

1. Field of the Invention

The present invention relates generally to a supply system for providing breathing gases to a recipient and, more particularly, to a lightweight, easily maintainable passenger oxygen mask for providing oxygen to an aircraft passenger or crew member.

2. Discussion of the Prior Art

At altitudes over 12,000 feet there is insufficient oxygen in the air for a person to remain alert and responsive, and because the level of oxygen in the air decreases further at higher altitudes, a person's health may be endangered by the lack of oxygen if ambient air is not supplemented.

It is known to provide oxygen supply equipment for supplying oxygen to an aircraft passenger when the normal supply of oxygen within the cabin of an aircraft is interrupted at altitudes over 12,000 feet.

Typically, the known type of system includes a face mask adapted to fit over the mouth and nose of the passenger and a reservoir bag in communication with the face mask for supplying a predetermined volume of oxygen to the mask. The bag is also connected to a hose which delivers oxygen to the bag from an oxygen supply. A flow indicator is typically provided on the hose, and a pull cord is affixed to the hose and to a valve in the supply system for initiating oxygen flow when the hose and cord are pulled from a storage location.

Although various constructions of the known type of system are employed in the art, each such construction secures the face mask, bag and hose together by a piece of string or the like within the bag which is attached at one end to the face mask and at the opposite end to the hose. The string prevents the face mask from being pulled from the bag and hose, adding strength to the assembly.

In order to maintain the reliability of aircraft passenger oxygen supply systems, the systems are inspected after every 5,000 hours of flight time of the aircraft, and the reservoir bag of each oxygen mask is replaced with a new bag. Unfortunately, because conventional masks use a string between the face mask and the supply tube, it is necessary to cut this string in order to remove the bag, and a new string must be tied between the mask and hose when a new bag is installed.

It would be desirable to provide a construction possessing the familiarity of known systems, while simplifying the construction and maintenance of the oxygen mask. Further, it would be beneficial to eliminate the need for a string in the device in order to simplify replacement of the reservoir bag.

OBJECTS AND SUMMARY OF THE INVENTION

It is an object of the present invention to provide a lightweight, easily maintainable passenger oxygen mask which may be assembled quickly and which employs a face mask, reservoir bag and supply hose that are separable from one another to permit ready replacement of parts.

It is another object of the present invention to provide an oxygen mask wherein the face mask, reservoir bag and supply hose, although easily replaceable, are prevented from breaking apart during use, and are strong enough to withstand pulling forces experienced between the hose and mask without the need for extraneous strengthening expedients such as a string or the like extending within the bag between the mask and hose.

In accordance with these and other objects evident from the following description, a lightweight, easily maintainable oxygen mask comprises a face mask sized to cover the mouth and nose of an oxygen recipient, and a reservoir bag attached to the face mask. The face mask includes an oxygen inlet through which oxygen may be delivered to the face mask, and the reservoir bag includes a bag outlet in communication with the oxygen inlet of the face mask, and a bag inlet. Preferably, the outlet is defined by a hole in the bag that is provided with a thickened edge around the hole forming a grommet.

A valve means permits oxygen to flow through the oxygen inlet into the mask, while preventing gas flow from the mask out the oxygen inlet, and a hose is connected to the bag inlet, the hose being adapted to be connected to a source of oxygen for supplying oxygen to the reservoir bag. A bag connector is positionable within the bag for pressing the grommet against the face mask around the oxygen inlet when the bag is connected to the face mask in order to seal the bag and the face mask, and cooperative structure is provided on the bag connector and the face mask for permitting the bag connector to be selectively, manually attached to and removed from the face mask.

In accordance with another aspect of the invention the oxygen mask includes a bag connector positionable within the bag for holding the bag against the face mask, and cooperative structure providing a snap-fit connection between the connector and the face mask for permitting the bag connector to be selectively, manually attached to and removed from the face mask.

By constructing an oxygen mask in accordance with the present invention, numerous advantages are achieved. For example, by providing a snap-fit connection at the point of attachment between the reservoir bag and the face mask, and by providing a grommet at the outlet of the bag that is pressed against the face mask when the parts are connected together, it is possible to provide a simple, detachable, sealed connection between the bag and the face mask which is strong enough to withstand pulling forces between the parts. Thus, by providing the reinforcement of the grommet at the outlet opening, the need for a string to reinforce the device is obviated.

Also, by providing a hose connector for connecting and disconnecting the bag and the hose, it is possible to simplify replacement of the bag between the face mask and the supply hose.

BRIEF DESCRIPTION OF THE DRAWING FIGURES

A preferred embodiment of the invention is described in detail below with reference to the attached drawing figures, wherein:

FIG. 5 is a sectional view of the face mask taken along line 5—5 of FIG. 3;

FIG. 6 is a sectional view of the face mask taken along line 6—6 of FIG. 3; and

FIG. 7 is a cross-sectional view of a hose used for delivering oxygen to the reservoir bag.

DETAILED DESCRIPTION OF THE PREFERRED EMBODIMENT

Figure 1:
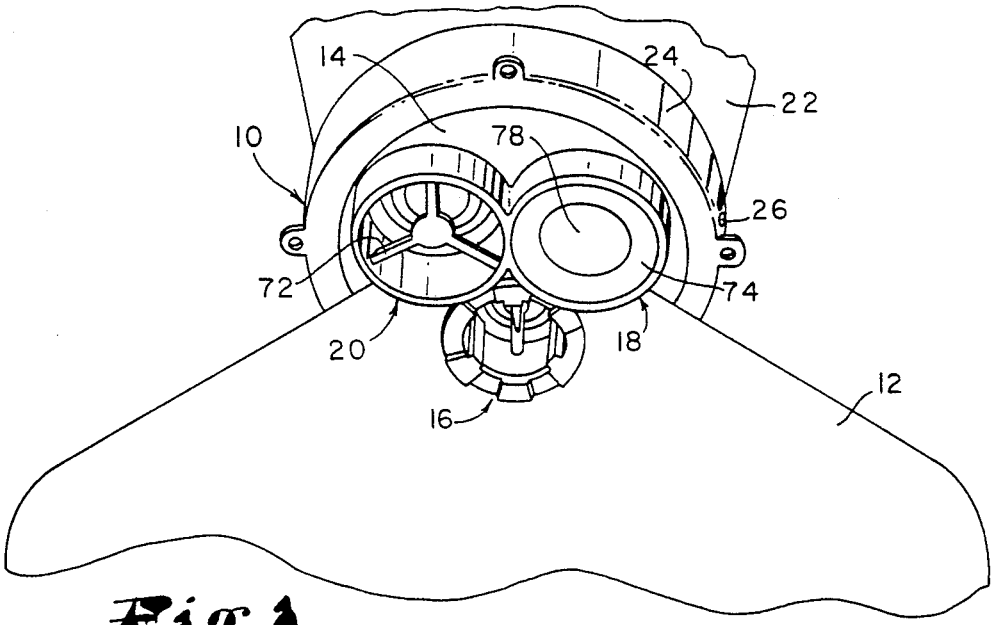
FIG. 1 is a perspective view of a face mask constructed in accordance with a preferred embodiment of the present invention, illustrating the exterior surface of the face mask and a reservoir bag connected to the face mask.

A lightweight, easily maintainable passenger oxygen mask constructed in accordance with a preferred embodiment of the present invention is illustrated in FIG. 1, and broadly includes a face mask 10 and a reservoir bag 12.

The face mask includes a housing 14 provided with three valve ports 16, 18, 20, a face cushion 22 sized to cover the mouth and nose of an oxygen recipient, and a retaining ring 24 encircling the face cushion and housing.

Figure 2:
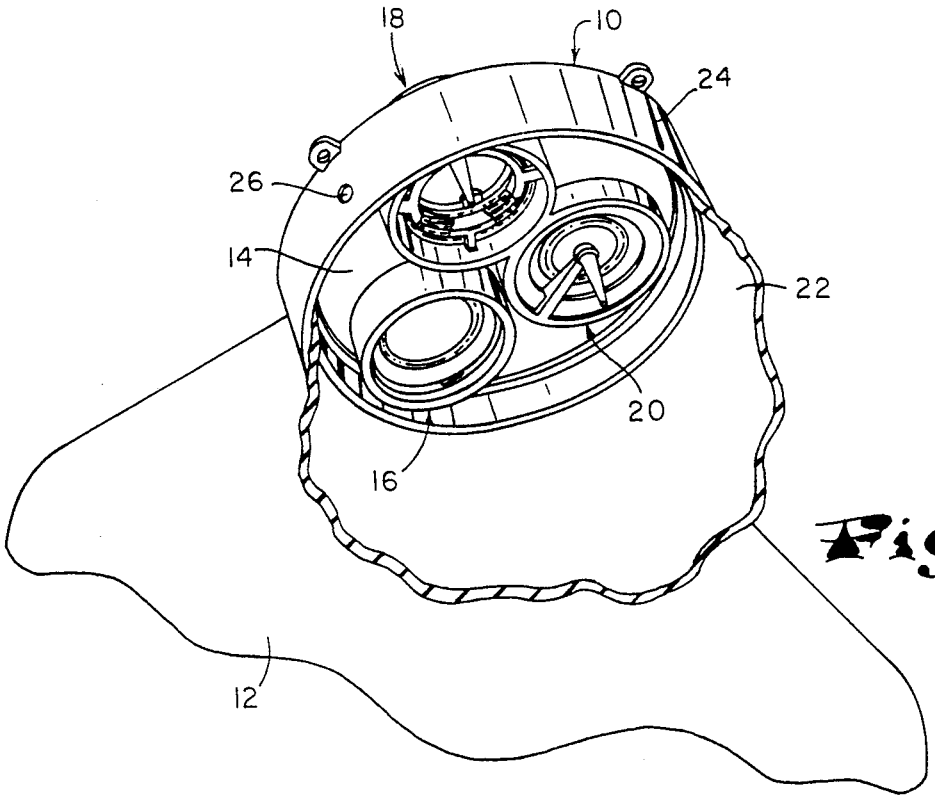
FIG. 2 is a perspective view of the face mask partially cut away, illustrating the interior of the face mask.

The housing 14 is formed of a lightweight, rigid material, and includes a circumferential edge having a diameter equal to or slightly greater than the inner diameter of one axial end of the face cushion 22. As shown in FIG. 2, the face cushion is formed of a resilient material that is pliable relative to the material used in the housing so that the shape of the cushion conforms generally to the shape of the recipient's face when placed thereagainst.

As shown in FIG. 5, one axial end of the cushion is of generally cylindrical shape and is adapted to fit over the circumferential edge of the housing. The diameter of the cushion increases toward the distal end forming a conical shape.

The retaining ring 24 is formed of a relatively rigid material and sandwiches the first end of the face cushion between the ring and the outer circumferential edge of the housing. Returning to FIG. 2, holes 26 are provided through opposite sides of the retaining ring for receiving the ends of an elastic head band 28 which is assembled on the face mask, as shown in FIG. 6.

During construction of the apparatus, the ends of the head band are inserted through the holes of the retaining ring from outside in, and the retaining ring is assembled over the cushion and housing so that the ends of the head band are retained on the device. Preferably, ultrasonic welding is used to affix the retaining ring and cushion to the housing without affecting the ability of the ends of the head band to be further adjusted relative to the mask.

Figure 3:
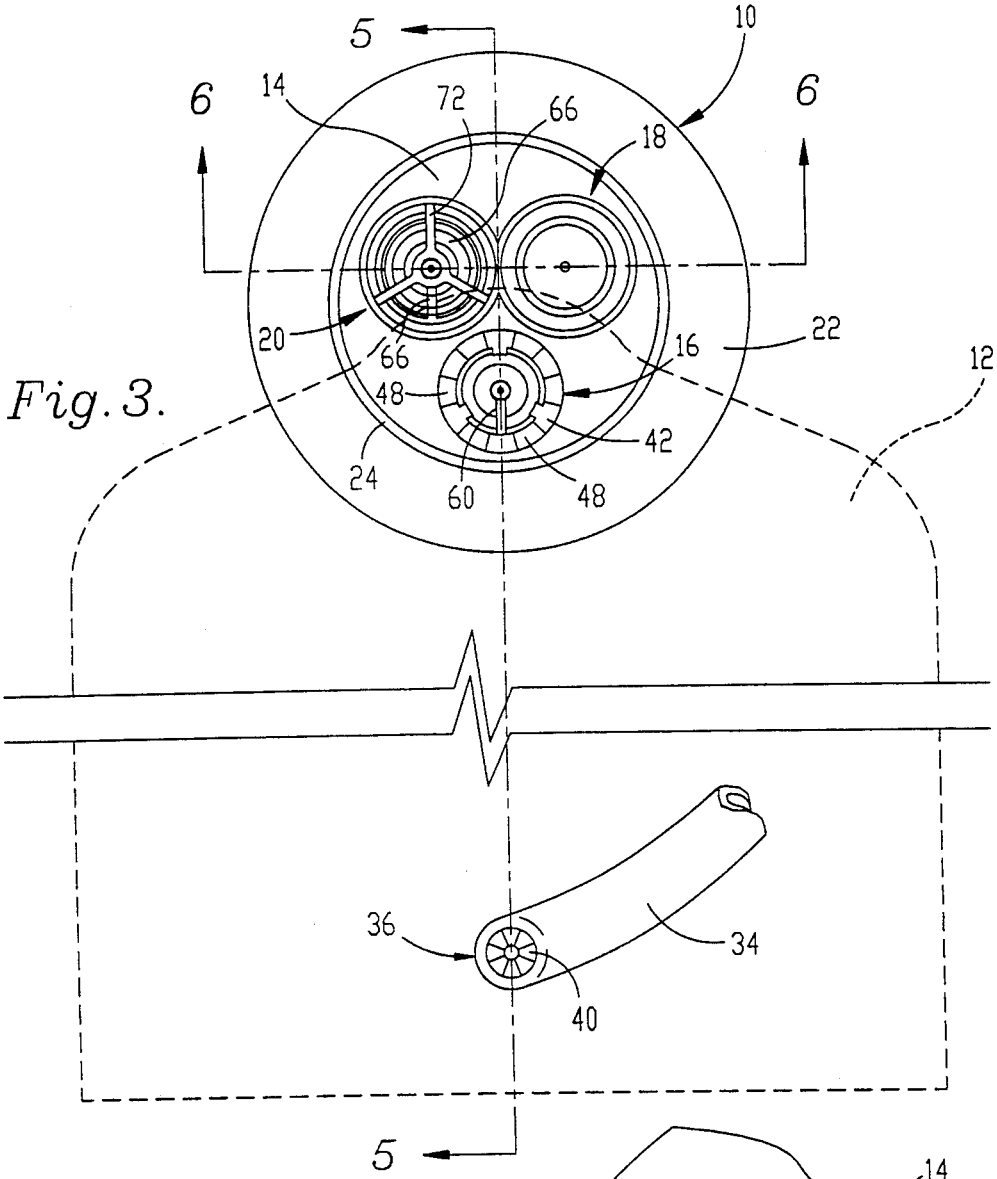
FIG. 3 is a plan view of the exterior surface of the face mask, illustrating the reservoir bag connected to the face mask.

Turning to FIG. 3, the reservoir bag 12 is formed of a collapsible material and is gas-tight except for a bag outlet and a bag inlet formed therein. As shown in FIG. 5, the bag is provided with grommets 30, 32 at the inlet and outlet which are used in a manner described below for sealing the connections between the bag 12 and the face mask 10, and between the bag and a supply hose 34 leading to a source of oxygen.

Preferably, the grommets 30, 32 are formed in the bag when the bag is produced by providing an edge of thickened material around the holes defining the inlet and outlet. In this manner, the grommets are accurately located and retained at the holes and reinforce the bag to inhibit tearing or stretching of the material.

The supply hose 34 is formed of a flexible hose material, and preferably includes an internal surface having a star-shaped cross-sectional appearance, as shown in FIG. 7, which reduces weight and prevents kinking. Turning to FIG. 5, the end of the hose to be connected to the bag is provided with a flat end surface adapted to press against the outer surface of the bag along the grommet 30.

A hose connector means is provided for connecting and disconnecting the bag 12 and the hose 34. The means includes a hollow hose connector 36 formed of a lightweight, relatively rigid material. The hose connector includes an elongated, cylindrical body portion and a head portion at one end of the body. The body portion has an outer diameter equal to or slightly greater than the smallest inner diameter of the hose 34 so that the hose may be forced over the surface of the body and moved toward the head.

Preferably, one or more circumferential ridges 38 are provided on the outer surface of the body to help retain the hose on the connector when assembled. The head includes an outer diameter greater than the diameter of the body, and is provided with a number of radially extending passages 40 which permit oxygen to flow between the connector and the bag.

In order to connect the hose to the bag, the hose connector 36 is positioned within the bag with the body protruding through the inlet. Thereafter, the end of the hose is pressed over the body and toward the head of the connector until the hose end presses against the bag. The grommet 30 provided at the inlet is pressed between the end of the hose and the head of the connector, and seals the inlet against leakage. Removal of the hose is carried out by forcing the hose manually from the connector over the ridges 38.

A bag connector means is provided for connecting and disconnecting the bag and the mask 10. The bag connector means includes a hollow bag connector 42 positionable within the bag for pressing the grommet 32 at the outlet of the bag against the housing 14 around the valve port 16 when the bag is connected to the face mask in order to seal the bag and the face mask against leakage.

Cooperative structure is provided on the bag connector 42 and the housing 14 for permitting the bag connector to be selectively, manually attached to and removed from the housing. Preferably, the bag connector is formed of a relatively rigid material and includes an O-ring having a flat bearing surface, and a plurality of fingers 44 each extending axially beyond the bearing surface and including a projection 46 protruding radially outward from the distal end of the finger. The surface of the connector 42 opposite the bearing surface is formed with a number of radially extending passages 48 through which oxygen is free to travel.

The valve port 16 includes a cylindrical gas flow passageway extending axially through the housing, as shown in FIG. 1. Turning to FIG. 5, a number of inclined grooves 50 are formed in the wall of the passageway and extend axially inward from the outer surface of the housing. A number of recesses 52 are also formed in the wall of the passageway and are aligned with the inclined grooves.

Each recess 52 is spaced axially from the groove aligned therewith in a direction toward the inner surface of a the housing. The grooves and recesses are aligned with the fingers 44 of the bag connector 42 so that when the fingers of the connector are aligned with the grooves and pressed axially into the passageway, the projections 46 on the fingers are pressed radially inward by the inclined grooves until the projections snap into the recesses 52. Thereafter, axial movement of the connector from the housing is prohibited and the connector is locked in place.

Figure 4:
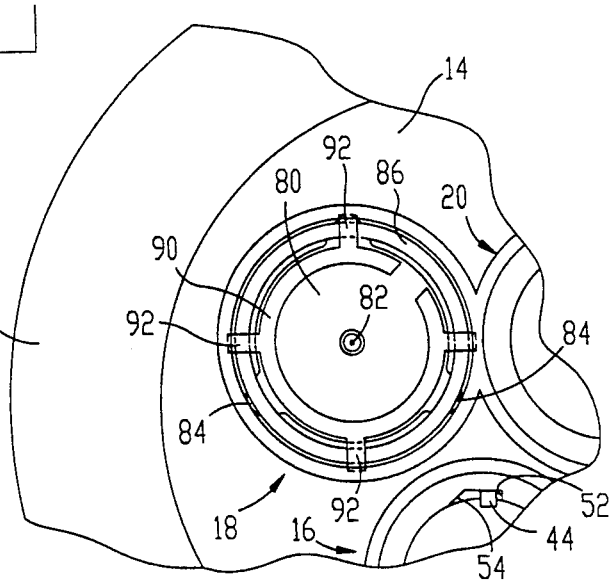
FIG. 4 is a fragmentary plan view of the interior surface of the face mask, illustrating an ambient air inlet and inlet valve provided on the face mask.

Turning to FIG. 4, each recess 52 formed in the wall of the passageway of the valve port 16 is illustrated as including a ramp surface 54 that is inclined from the bottom of the recess toward the wall of the passageway. This ramp permits the bag connector to be removed from the housing by forcing the projections 46 on the fingers 44 radially inward when the bag connector is rotated within the passageway, thus urging the projections from the recesses so that the bag connector may be axially pulled from the passageway, and the bag removed from the housing.

The valve associated with the valve port 16 is shown in FIG. 5, and includes an annular seat 56 formed in the inner surface of the housing around the passageway, and a flexible diaphragm 58 that normally rests against the seat, but which may be forced or drawn away from the seat when the pressure in the bag exceeds the pressure within the face mask, such as during inhalation by the passenger or recipient.

The diaphragm is supported on a mounting arm 60 that is formed as a part of the housing and which extends radially inward from the wall of the passageway. The diaphragm includes an elongated body having a reduced diameter throat received in a hole formed in the arm, and a pull tab 62 extending beyond the throat away from the diaphragm. During assembly of the apparatus, the pull tab is threaded through the hole in the arm 60 and manually pulled until the throat is snap-fit in position on the arm. Thus, the pull tab permits the diaphragm to be easily assembled.

Turning to FIG. 6, the remaining two valve ports 18, 20 in the housing are shown. The valve port 20 is an exhaust port, and includes a passageway defining a valve seat 64 against which a diaphragm 66 normally rests, and an arm 68 extending radially inward from the wall of the passageway to the central axis defined by the passageway. The diaphragm 66 includes an elongated body having a reduced diameter throat received in a hole formed in the arm, and a pull tab 70 similar to the pull tab of diaphragm 58.

During use of the apparatus, the diaphragm 66 is moved away from the seat 64 and air is exhausted from within the face mask when the pressure therein exceeds ambient pressure. A cage 72 is provided within the passageway adjacent the outer surface of the housing opposite the diaphragm 66 for preventing physical intrusion into the passageway which would prevent lifting of the diaphragm from the seat during exhalation. Preferably, the cage is a separate piece that may be assembled on the housing after assembly of the diaphragm on the arm.

The valve port 18 accommodates an air inlet valve for permitting ambient air to be drawn into the face mask along with oxygen from the bag whenever the passenger or recipient inhales. The valve port includes a passageway that is provided with a circumferential flange 74 extending inward from the wall of the passageway to define a valve seat. A plurality of radially extending recesses 76 are also formed in the passageway adjacent the inner surface of the housing and opposite the seat. The air inlet valve includes a flat diaphragm 78 provided with an elongated body having a reduced diameter throat received in a hole formed in a backing plate 80 that is movable with the diaphragm between a flow permitting and a flow blocking position. The diaphragm also includes a pull tab 82 that permits the diaphragm to be quickly assembled on the backing plate.

As shown in FIG. 4, the backing plate 80 includes three positioning nibs 84 extending radially outward from the outer circumferential edge of the backing plate and centering the backing plate and diaphragm within the passageway so that when the diaphragm 78 is in the flow-permitting position, air is free to pass around the diaphragm and backing plate through the passageway.

Returning to FIG. 6, a compression spring 86 is provided in the passageway for urging the backing plate and diaphragm toward the flow-blocking position. A number of upstanding buttons 88 are provided on the surface of the backing plate opposite the diaphragm for locating the compression spring on the backing plate.

A retaining clip 90 is disposed within the passageway opposite the flange 74 for holding the compression spring against the backing plate 80. As shown in FIG. 4, the retaining clip 90 is a C-shaped clip having a number of ears 92 protruding radially therefrom which are received in the recesses 76 to position the retaining clip relative to the housing. The ears of the retaining clip also retain the compression spring within the passageway.

During use, once the flow of oxygen to the bag is initiated and a supply of oxygen is present within the bag, the recipient positions the face cushion over their mouth and nose and positions the head band around their head to retain the face mask in place.

Upon inhalation, oxygen from the bag passes through the valve port 16, and ambient air enters the mask through valve port 18 to permit the passenger or recipient to take a full and complete breath. Thereafter, when the passenger exhales, the diaphragms 58, 78 seat to prevent air from passing back through the ports 16, 18, and the diaphragm 66 is unseated to exhaust the breath.

During routine maintenance of the apparatus, the bag may be replaced by pulling the hose from the hose connector, and twisting the bag connector within the passageway of the valve port 16 to force the finger projections 46 from the recesses 52 and pulling the bag connector from the housing. New bags are then installed as already described above.

Although the invention has been described with reference to the preferred embodiment illustrated in the drawing figures, it is understood that substitutions may be made and equivalents employed herein without departing from the scope of the invention as recited in the claims.

What is claimed is:

1. A lightweight, easily maintainable oxygen mask comprising:

a face mask sized to cover the mouth and nose of an oxygen recipient, and including an oxygen inlet through which oxygen may be delivered to the face mask, the inlet including a passageway in which a plurality of recesses are formed;

a reservoir bag including a bag outlet in communication with the oxygen inlet of the face mask, and a bag inlet, the outlet being defined by a hole in the bag and including a thickened edge around the hole forming a grommet;

a valve means for permitting oxygen to flow through the oxygen inlet into the mask, while preventing gas flow from the mask out the oxygen inlet;

a hose including a first end connected to the bag inlet, the hose being adapted to be connected to a source of oxygen for supplying oxygen to the reservoir bag; and a bag connector means for connecting and disconnecting the bag and the mask, the bag connector means including a bag connector formed of an annular ring defining a bearing surface, and a plurality of fingers extending axially of the ring in a direction perpendicular to the bearing surface, the fingers including radially extending projections aligned with the recesses in the passageway of the mask so that when the bag outlet is positioned over the oxygen inlet of the mask and the fingers of the bag connector are inserted in the passageway, the projections engage the recesses securing the connector to the mask and pressing the grommet against the face mask around the oxygen inlet.

2. An oxygen mask as recited in claim 1, wherein the face mask includes an ambient air inlet and a valve means for permitting air to flow through the ambient air inlet into the mask when a predetermined pressure drop is exceeded within the mask relative to ambient pressure.

3. An oxygen mask as recited in claim 1, wherein the face mask includes a mask outlet and a valve means for permitting air to be exhausted from the mask.

4. An oxygen mask as recited in claim 1, further comprising a hose connector means for connecting and disconnecting the bag and the hose.

5. An oxygen mask as recited in claim 4, wherein the hose connector means includes a hose connector positionable within the bag for pressing the bag against the first end of the hose around the bag inlet when the bag is connected to the hose, and cooperative structure on the hose connector and the hose for permitting the hose to be selectively attached to and removed from the bag.

6. An oxygen mask as recited in claim 5, wherein the bag is provided with a grommet surrounding the bag inlet, the hose connector pressing the grommet against the first end of the hose in order to seal the bag and the hose.

7. An oxygen mask as recited in claim 1, wherein the hose includes an inner surface having a star-shaped cross-sectional area.

* * * * *